US008005416B2

(12) United States Patent
Ohno et al.

(10) Patent No.: US 8,005,416 B2
(45) Date of Patent: Aug. 23, 2011

(54) GRIPPING DEVICE, PLATE MEMBER, AND GRIPPING METHOD

(75) Inventors: Takashi Ohno, Ebina (JP); Yusaku Sato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 275 days.

(21) Appl. No.: 12/277,510

(22) Filed: Nov. 25, 2008

(65) Prior Publication Data

US 2009/0320707 A1 Dec. 31, 2009

(30) Foreign Application Priority Data

Jun. 25, 2008 (JP) ..... 2008-165427

(51) Int. Cl.
*G03G 21/00* (2006.01)

(52) U.S. Cl. ..... 399/351; 399/123; 399/343; 101/408

(58) Field of Classification Search ..... 399/107, 399/110, 123, 343, 350, 351
See application file for complete search history.

(56) References Cited

U.S. PATENT DOCUMENTS

| | | | | |
|---|---|---|---|---|
| 4,805,893 | A * | 2/1989 | Kusaka | 271/258.01 |
| 5,878,306 | A * | 3/1999 | Michlin | 399/106 |
| 6,131,011 | A * | 10/2000 | Kojima et al. | 399/351 |
| 2004/0120728 | A1 * | 6/2004 | Ziegelmuller et al. | 399/123 |

FOREIGN PATENT DOCUMENTS

| | | |
|---|---|---|
| JP | 06-130877 | 5/1994 |
| JP | 2000-075753 | 3/2000 |

* cited by examiner

*Primary Examiner* — David P Porta
*Assistant Examiner* — Jessica L Eley
(74) *Attorney, Agent, or Firm* — Morgan, Lewis & Bockius LLP

(57) ABSTRACT

A gripping device that grips a plate member provided with a long plate body, a first recess formed along a shorter length of the plate body, and a second recess formed at a position spaced apart from the first recess along a longer length of the plate body, the gripping device including: a first movable member entering the first recess; a second movable member entering the second recess; and opposing members opposed to the first and second movable members along the shorter length of the plate body and serving to grip the plate member in cooperation with the first and second movable members, wherein the gripping device grips the plate member by causing the second movable member to press against at least two positions of the second recess as well as the first movable member to press against a bottom of the first recess.

14 Claims, 10 Drawing Sheets

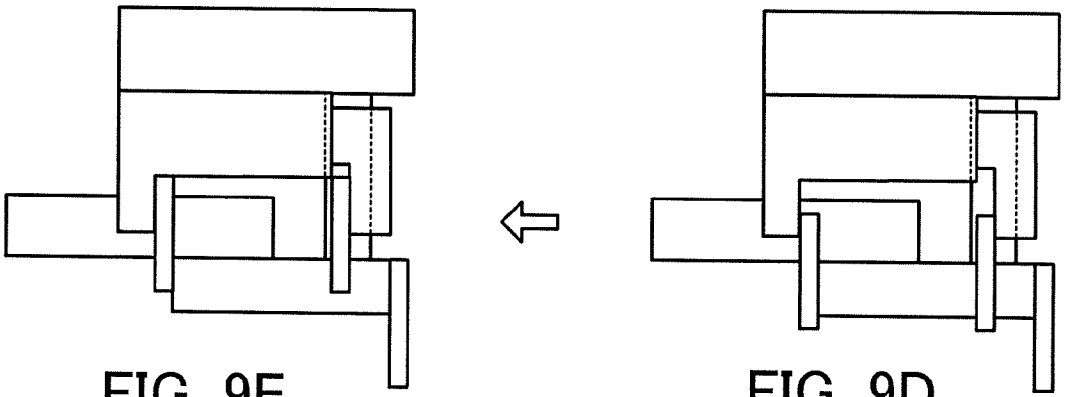
FIG. 9D
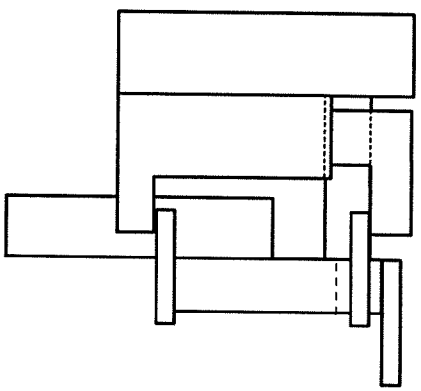
FIG. 9C
FIG. 9E
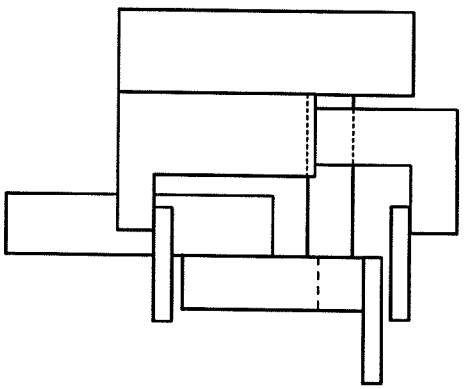
FIG. 9B
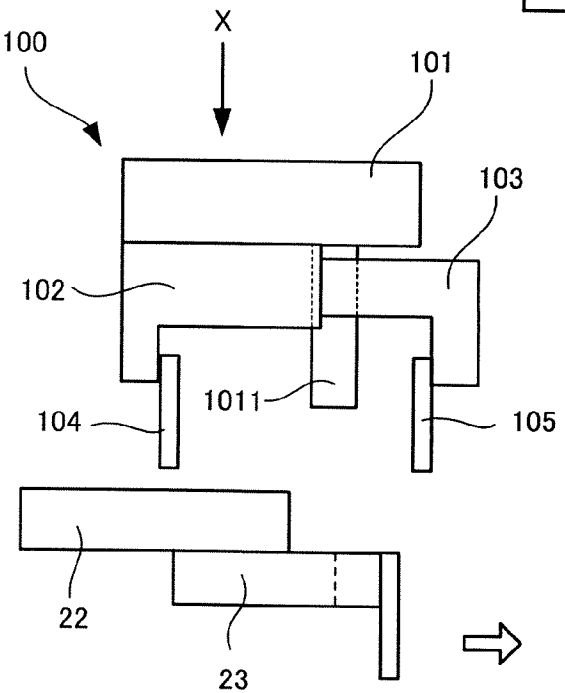
FIG. 9A

GRIPPING DEVICE, PLATE MEMBER, AND GRIPPING METHOD

CROSS-REFERENCE TO RELATED APPLICATIONS

This application is based on and claims priority under 35 USC 119 from Japanese Patent Application No. 2008-165427 filed Jun. 25, 2008.

BACKGROUND (i) Technical Field

The present invention relates to a plate member, a gripping device that grips the plate member, and a gripping method of the plate member.

(ii) Related Art

Conventionally, there have been known an image forming apparatus in which a toner-developed image formed on an image carrier is transferred and fixed onto a recording medium, thereby forming an image on the recording medium. Some such image forming apparatuses are provided with a cleaning unit that causes the tip of a cleaning blade to touch the surface of the image carrier after the developed image is transferred onto the recording medium, thereby cleaning unnecessary matters such as toner residues remaining on the surface of the image carrier.

Further, some such cleaning units are designed to collect the unnecessary matters scraped by the cleaning blade and to store them in a casing of the cleaning unit. The blade is fixed to part of the casing by means of a plate member that supports the blade.

It is conceivable that the procedure of attaching the plate member supporting the blade to the casing can be automated by using a robot system with multiple arms. In the automated system, for example, one of the multiple arms has, on its front end, a component gripping device that grips a plate member. More specifically, each of the plate members is accommodated in an accommodation area on a predetermined tray where multiple accommodation areas are arranged. The plate member accommodated on the tray is gripped by the component gripping device. The plate member gripped by the component gripping device is carried, as the arm moves, to a different location where a casing is placed and is attached to a predetermined location. Subsequently, a fixing device attached to a front end of the robot's different arm secures the plate member to the casing.

The accommodation area on the tray used in such an automated system has a size sufficient for the plate member. Thus, even when the multiple accommodation areas are arranged regularly on the tray, positions of the plate members in the accommodation areas on the accommodation tray are likely to be irregular. Accordingly, in order to enable easy attachment of the plate member at a predetermined position on the casing, the plate member needs to be gripped at a fixed position of the component gripping device.

Here, it is conceivable to form notches, at both ends of the plate member, having such a shape that becomes narrower as it goes further in the depth direction, i.e., the center, and move pins provided at the component gripping device toward the center to slide into the notches and grip the plate member by the component gripping device. This idea is deemed to rectify irregular positions of the plate members in the accommodation areas on the tray and enable the plate members to be gripped at a fixed position of the component gripping device.

However, due to recent demands for a smaller image forming apparatus, layout of the plate member in the longitudinal direction is restricted. Thus, it is difficult to secure a space for notches to be formed in the both ends of the plate member and to be used for the component gripping device to grip the plate member.

This problem is not limited to the plate member that is used for automatic assembly of an image forming apparatus, and may occur in any device that is automatically assembled by using a plate member that is restricted in terms of layout in the longitudinal direction.

SUMMARY

According to an aspect of the present invention, there is provided a gripping device that grips a plate member provided with a long plate body, a first recess formed as a part of the plate body and has a shape recessed along a shorter length of the plate body, and a second recess formed as a part of the plate body at a position spaced apart from the first recess along a longer length of the plate body and has a shape recessed along the shorter length of the plate body, the gripping device including: a first movable member entering the first recess; a second movable member entering the second recess; and an opposing member group including at least one opposing member, the opposing member group being opposed to the first and second movable members along the shorter length of the plate body and serving to grip the plate member along the shorter length of the plate body in cooperation with the first and second movable members, wherein the gripping device grips the plate member by causing the second movable member to press against at least two positions of the second recess as well as causing the first movable member to press against a bottom of the first recess.

BRIEF DESCRIPTION OF THE DRAWING

Exemplary embodiments of the present invention will be described in detail based on the following Figures, wherein:

FIGS. 9A-9E are schematic views of a component gripping device as viewed from its side surface.

DETAILED DESCRIPTION

The exemplary embodiments of the present invention will be described below by referring to the attached drawings.

A component gripping device that is one exemplary embodiment of a gripping device according to the present invention serves to grip a component and is attached to one of arms of an industrial robot used for an automatic assembly line for a cleaning unit constituting an image forming apparatus that forms an image on a sheet. Hereafter, the structure of the image forming apparatus will be described first, followed by description of a component gripping device used in a process of assembling the cleaning unit constituting the image forming apparatus and detailed description of a blade supporting plate that is one exemplary embodiment of a plate member according to the present invention, is a part of the cleaning unit and gripped by the component gripping device at automatic assembly for the cleaning unit.

Figure 1:
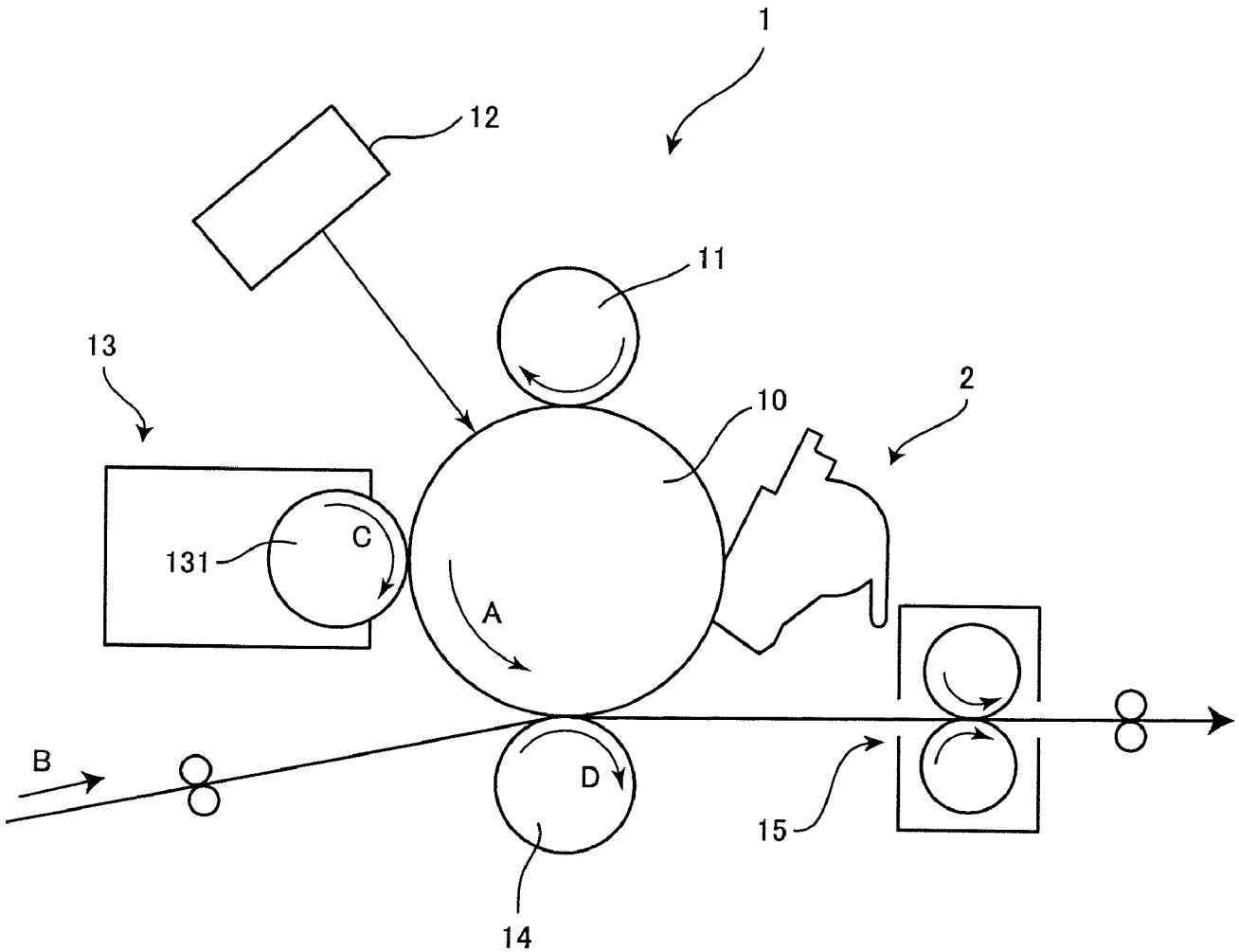
FIG. 1 is a schematic sectional view of an image forming apparatus.

FIG. 1 is a schematic sectional view of an image forming apparatus.

In an image forming apparatus 1 shown in FIG. 1, a surface of a photoreceptor drum 10 that rotates in the direction indicated by the arrow A is given a predetermined charge by a charging roll 11, and irradiated with an exposure light that is generated at an exposure unit 12 based on image data. A resultant latent image formed on the surface of the photoreceptor drum 10 is developed with toner stored in a developing unit 13 provided with a developing roll 131 that rotates in the direction indicated by the arrow C. The developed image is transferred by a transfer roll 14 rotating in a direction indicated by the arrow D and is fixed onto a sheet of recording paper pulled out of a paper cassette (not shown) and conveyed in the direction of the arrow B and fixed by a fuser 15, which forms an image on the sheet of recording paper. Incidentally, the image forming apparatus 1 is intended for a solid color image.

In addition, FIG. 1 shows a cleaning unit 2 that touches part of the photoreceptor drum 10 where the developed image is already transferred onto the sheet of recording paper and thereby removes unnecessary matters remaining on the surface of the photoreceptor drum 10.

Figure 2:
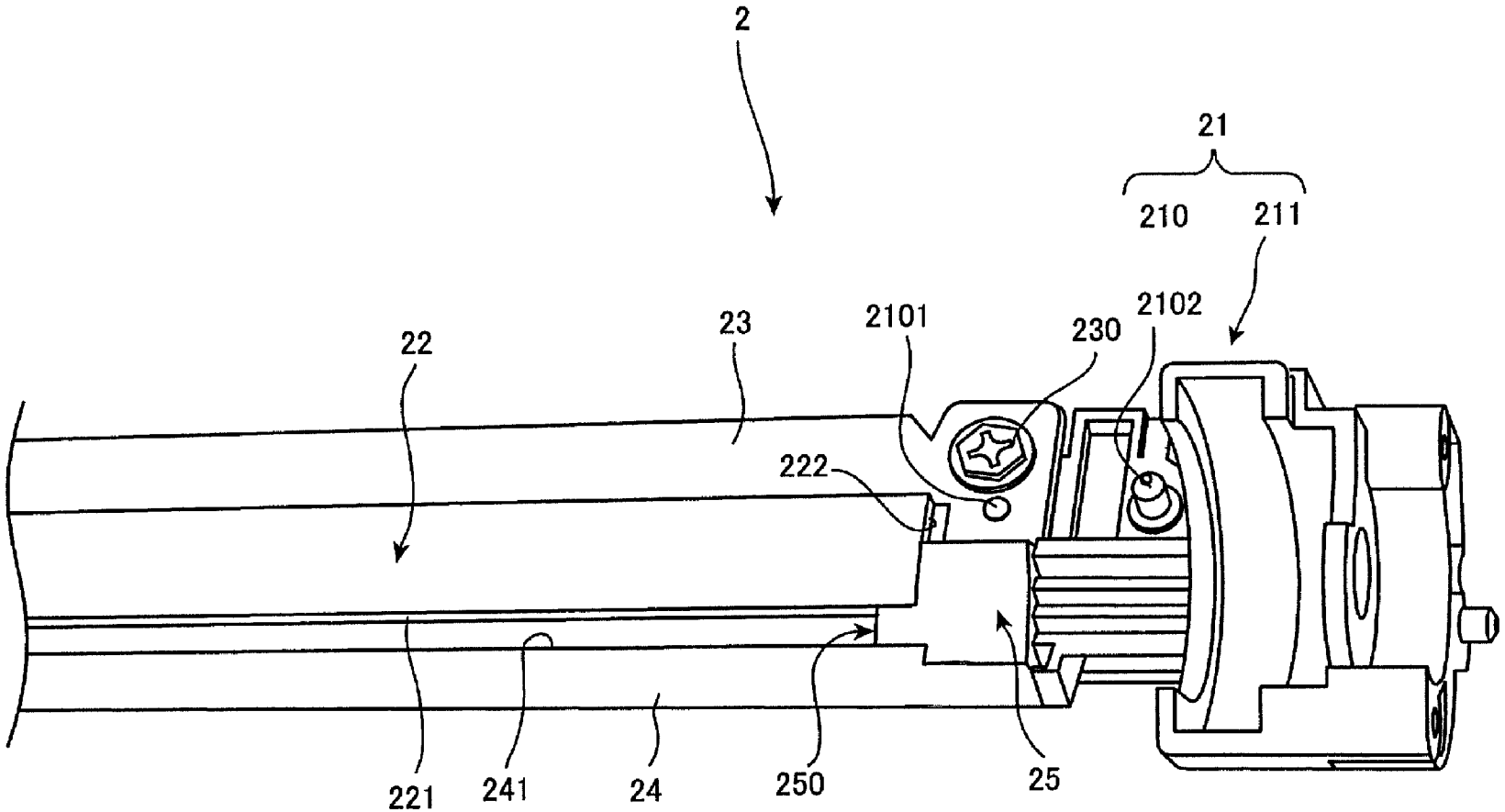
FIG. 2 is an external view of part of a cleaning unit.

FIG. 2 is an external view of part of the cleaning unit 2.

FIG. 2 shows one end of the cleaning unit 2 viewed from the developing unit 13 over the photoreceptor drum 10. As the cleaning unit 2 is symmetrical, only the one end thereof shown in FIG. 2 will be described hereafter.

The cleaning unit 2 has a cleaning frame 21, a blade 22, a blade supporting plate 23 for supporting the blade 22, a film member 24, and a pair of sliding felt members 25.

The blade 22 is an elastic body serving to remove unnecessary matters remaining on the surface of the photoreceptor drum 10 that an edge of a blade 221 touches. And for example, a blade made of rubber can be used.

The blade supporting plate 23 is a metal plate member for supporting the blade 22 and secured to the cleaning frame 21 with a screw 230.

The cleaning frame 21 has a concave opening for storing unnecessary matters removed from the surface of the photoreceptor drum 10, a main body 210 to which the blade supporting plate 23 for supporting the blade 22 is secured, and a holding portion 211 for rotatably holding the both ends of the photoreceptor drum 10. It should be noted that the main body 210 is provided with a boss 2101 used for positioning the blade supporting plate 23 as well as a boss 2102 used for "arranging a charging frame that houses a charging member (not shown) at a predetermined position of the cleaning frame 21." The blade supporting plate 23 for supporting the blade 22 is screwed onto the cleaning frame 21 via thermoplastic elastomer that is a liquid sealant applied to a periphery of an entrance 210*a* of the cleaning frame 21, which will be described later in detail.

The felt member 25 is formed of a felt layer that is a surface layer and an elastic layer that is an under layer (unshown). The felt layer 25 also has a protrusion portion 250 that is protruding toward the entrance 210*a*.

FIG. 2 shows a state in which a side surface of the protrusion portion 250 and another blade-side surface of the felt member 25 other than the protrusion portion 250 are tight close to the corner of the blade 22. Thus, it is possible to prevent escape of unnecessary matters through a side surface 222 of the blade 22.

The film member 24 is a polyurethane film. A front edge 241 of the film member 24 is designed to touch the photoreceptor drum 10 held by the holding portion 211 of the cleaning frame 21, thereby preventing escape of unnecessary matters through a peripheral portion H.

Figure 3:
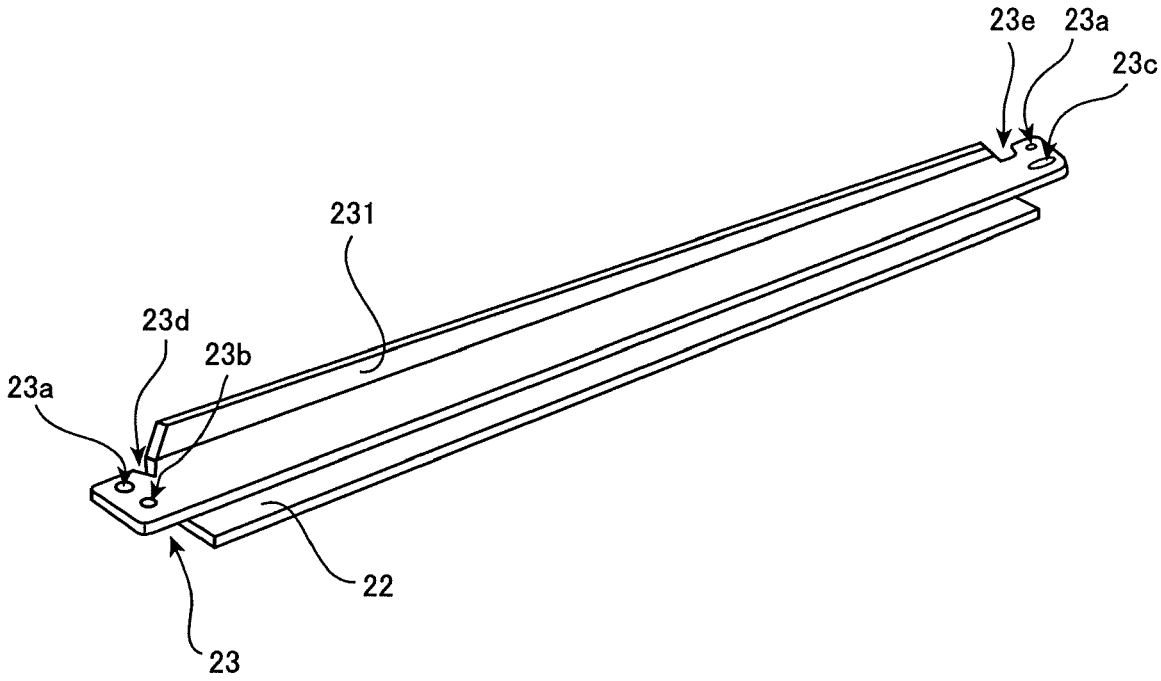
FIG. 3 is a view of a blade supporting plate that supports a blade.

FIG. 3 is a view of the blade supporting plate 23 that supports the blade 22.

In FIG. 3, the blade supporting plate 23 supporting the blade 22 before being screwed to the cleaning frame 21 of the cleaning unit 2 shown in FIG. 2 is shown with its surface facing the cleaning frame 21 directed upward in the drawing.

Also, shown in FIG. 3 is that the blade supporting plate 23 is provided with a through hole 23*a* through which the screw 230 shown in FIG. 2 is passed and a through hole 23*b* through which the boss 2101 of the cleaning frame 21 is passed.

Further, as shown in FIG. 3, the blade supporting plate 23 has a bent portion 231 formed by bending part of the blade supporting plate 23 so as to enhance its own rigidity. The blade supporting plate 23 also has a triangle notch 23*d* and a rectangular notch 23*e* (see FIG. 8) respectively formed in areas adjacent to the ends of the bent portion 231 so as to prevent deformation of the bent portion 231 when being bent. The details will be described later.

Figure 4:
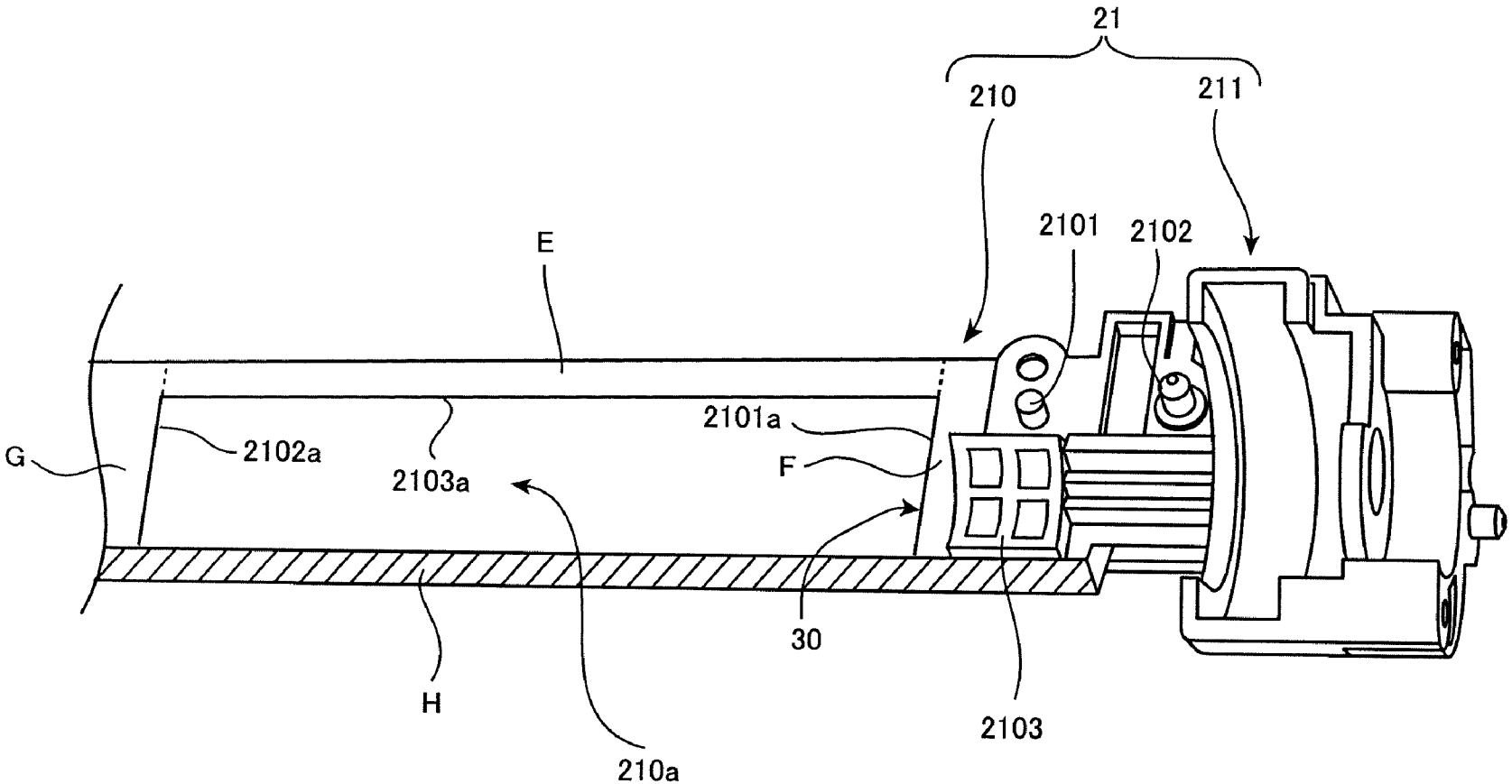
FIG. 4 is a view showing a cleaning frame.

FIG. 4 is a view showing the cleaning frame 21.

FIG. 4 shows the cleaning frame 21 before the blade supporting-plate 23, the felt member 25 and the film member 24 are attached to its main body 210. In the Figure, the entrance 210*a* that is a concave opening for storing unnecessary matters is exposed. A peripheral portion E, a peripheral portion F, and a peripheral portion G that surround the entrance 210*a* are located on the same plane that is perpendicular to a plane where the peripheral portion H is located.

Here, edges 2101*a* and 2102*a* define the entrance 210*a* for the concave opening in the axial direction of the photoreceptor drum 10 which direction is perpendicular to rotation of the surface thereof, while an edge 2103*a* defines the entrance 210*a* in the direction along the side of the entrance 210*a* where the blade supporting plate 23 is disposed. The remaining edge defines the entrance 210*a* in the direction along the side of the entrance 210*a* where the film member 24 is disposed. The peripheral portion F and the peripheral portion G respectively include areas along portions of the cleaning frame 21 formed by the edges 2101*a* and 2102*a* as well as an area between the portions formed by the edges 2101*a* and 2102*a* and ends of the blade 22 in the axial direction of the photoreceptor drum 10, according to the present exemplary embodiment. The peripheral portion E includes an area along a portion formed by the edge 2103*a* as well as an area where the blade supporting plate 23 faces the cleaning frame 21 outside the portion formed by the edge 2103*a* away from the concave opening, according to the present exemplary embodiment. The periphery portion H includes an area along a portion formed by the edge on the side of the film member 24 as well as an area between the portion and the film member 24.

Figure 5:
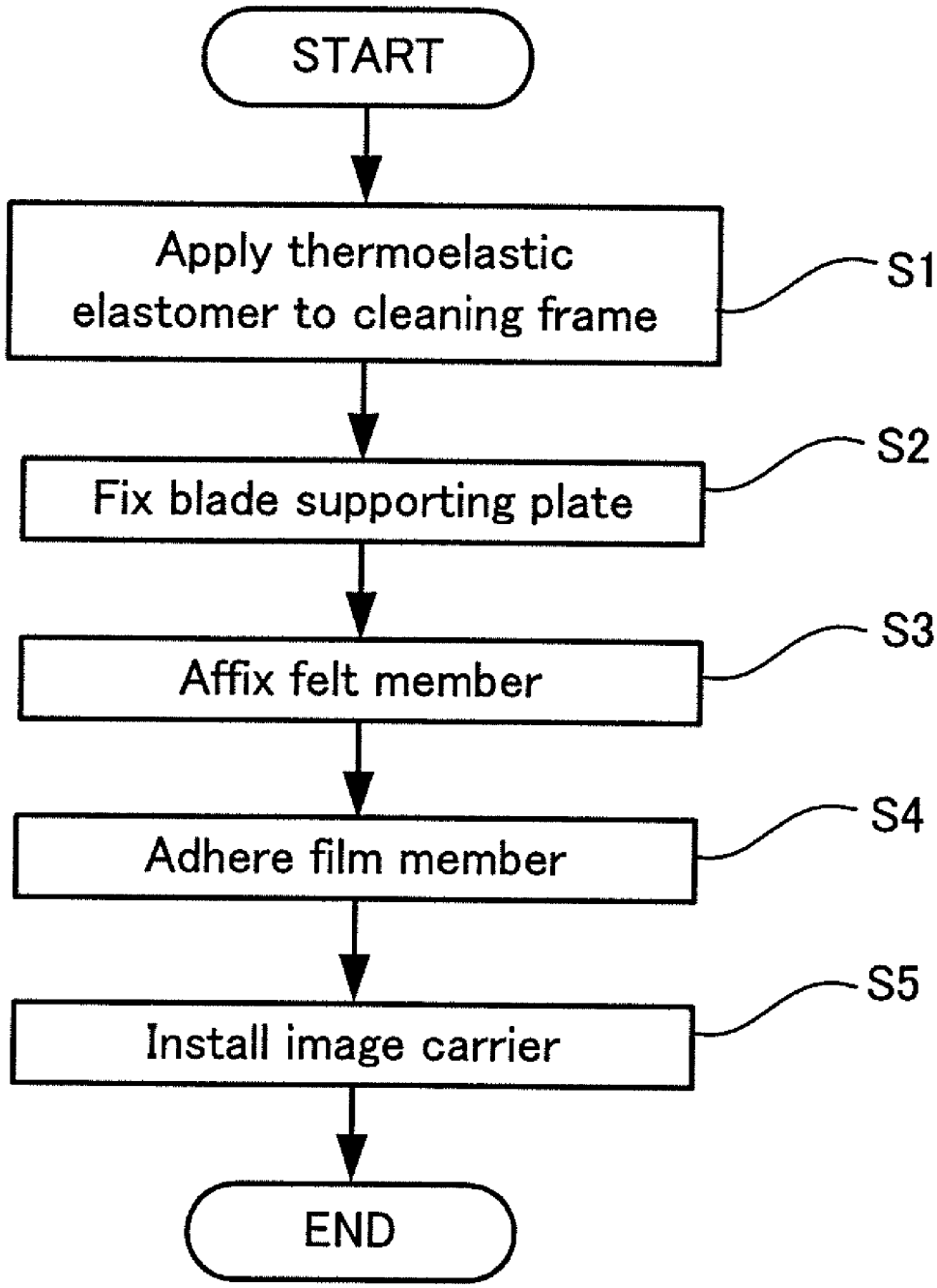
FIG. 5 is a view showing a flow of assembling the cleaning unit.
Figure 6:
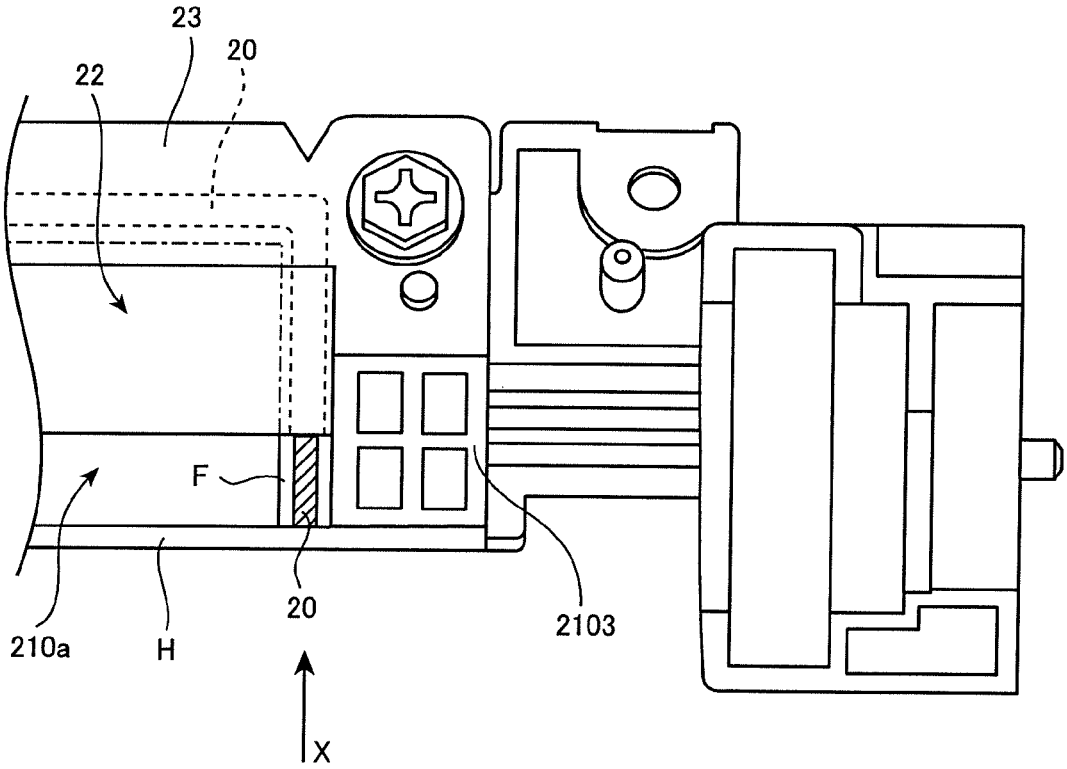
FIG. 6 shows the cleaning frame attached with the blade supporting plate.

Hereafter, a method of assembling the cleaning unit 2 will be briefly described referring to FIG. 5 and FIG. 6.

FIG. 5 is a view showing a flow of assembling the cleaning unit 2.

In step S1 of FIG. 5, a liquid thermoelastic elastomer 20, which is to coagulate and thereby seal the gap between members, is applied to the peripheral portions E, F, and G forming the periphery of the entrance 210*a* of the cleaning frame 21. In step S2, the blade supporting plate 23 supporting the blade 22 is screwed and thereby fixed onto the cleaning frame 21. In this state, part of the peripheral portions E, F, and G are covered by the blade supporting plate 23 supporting the blade 22, so that the entrance 210*a* becomes narrower compared with the one shown in FIG. 4.

FIG. 6 shows the cleaning frame 21 attached with the blade supporting plate 23. In FIG. 6, edges of the entrance 210*a* that are invisible covered with the members are expressed in dashed lines. The thermoelastic elastomer 20 applied to the periphery portions that is invisible covered with members is expressed in dotted lines.

In FIG. 6, thermoelastic elastomer 20 that is applied to the peripheral portions E-G forming the periphery of the entrance 210*a* and that is covered with the blade supporting plate 23 supporting the blade 22 is pressed and extended in the lateral direction when the blade supporting plate 23 is fixed to the cleaning frame 21. Now, descriptions will continue referring back to FIG. 5.

In step S3, the felt member 25 is affixed to a felt member affixing surface 2103 (see FIG. 6). In step S4, the film member 24 is adhered onto the periphery portion H via a double-sided adhesive tape. This is a brief description of an assembly method of the cleaning unit 2.

Subsequently, in step S5, the photoreceptor drum 10 is rotatably installed onto the holding portion 211 of the assembled cleaning frame 21.

Now, the process of step S2 in FIG. 5 will be described in detail. Specifically, description will be made on an automatic process in which a component gripping device 100 performs a process of mounting the blade supporting plate 23 supporting the blade 22 to the cleaning frame 21 whose periphery portions E-G are applied with the thermoelastic elastomer 20. It should be noted that other processes including applying thermoelastic elastomer 20 onto the periphery portions E-G of the cleaning frame 21 and screwing the blade supporting plate 23 to the cleaning frame 21 are also automatically performed respectively by exclusive devices mounted on the multiple arms of an industrial robot that presents the exclusive devices alternately to a worktable.

In the mounting process, the blade supporting plate 23 is mounted onto the cleaning frame 21 placed at a predetermined position on the worktable with its periphery portions E-G applied with the thermoelastic elastomer. At first, the component gripping device 100 installed at the front end of the arm grips one of the multiple blade supporting plates 23 accommodated in an accommodation tray. Subsequently, the blade supporting plate 23 gripped by the component gripping device 100 is carried, as the arm tracing a predetermined path, close to a target mounting position on the cleaning frame 21 placed on the working table. Further, the bosses 2101 formed on the cleaning frame 21 are inserted respectively into the round hole 23*b* and a long hole 23*c* formed in the blade supporting plate 23, thereby performing final positioning of the blade supporting plate 23 relative to the cleaning frame 21.

Figure 7:
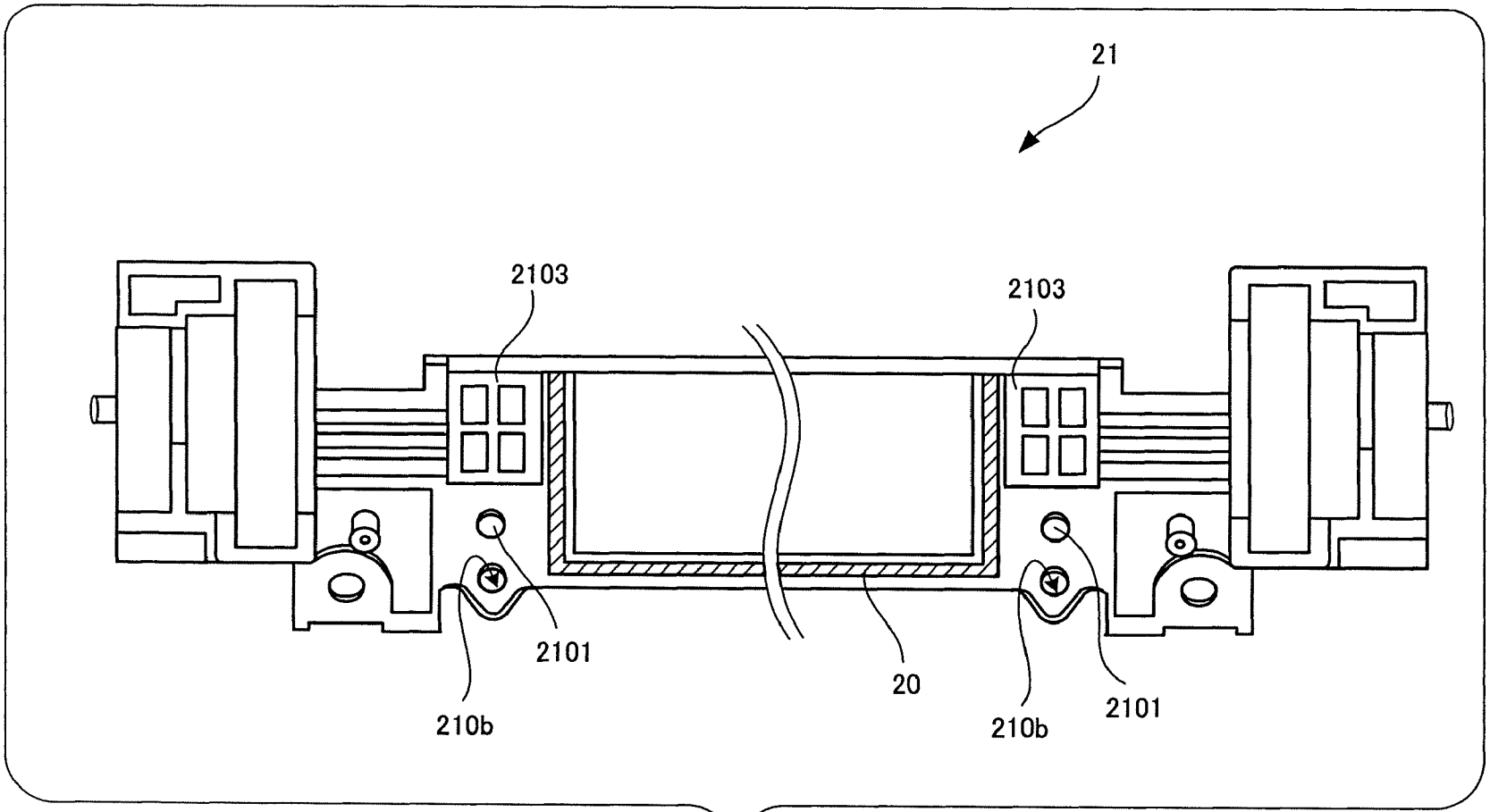
FIG. 7 is a top view of the cleaning frame.

FIG. 7 is a top view of the cleaning frame 21.

In FIG. 7, the cleaning frame 21 with its periphery portions E-G applied with thermoelastic elastomer 20 is shown upside down relative to the one shown in FIG. 6.

Also, in FIG. 7, the bosses 2101 to be used for positioning the blade supporting plate 23 on the cleaning frame 21 are shown below the felt member affixing surface 2103 onto which the felt member 25 is to be affixed. Further, threaded holes 210*b* to be used for screwing the blade supporting plate 23 into the cleaning frame 21 are shown below the bosses 2101.

Figure 8:
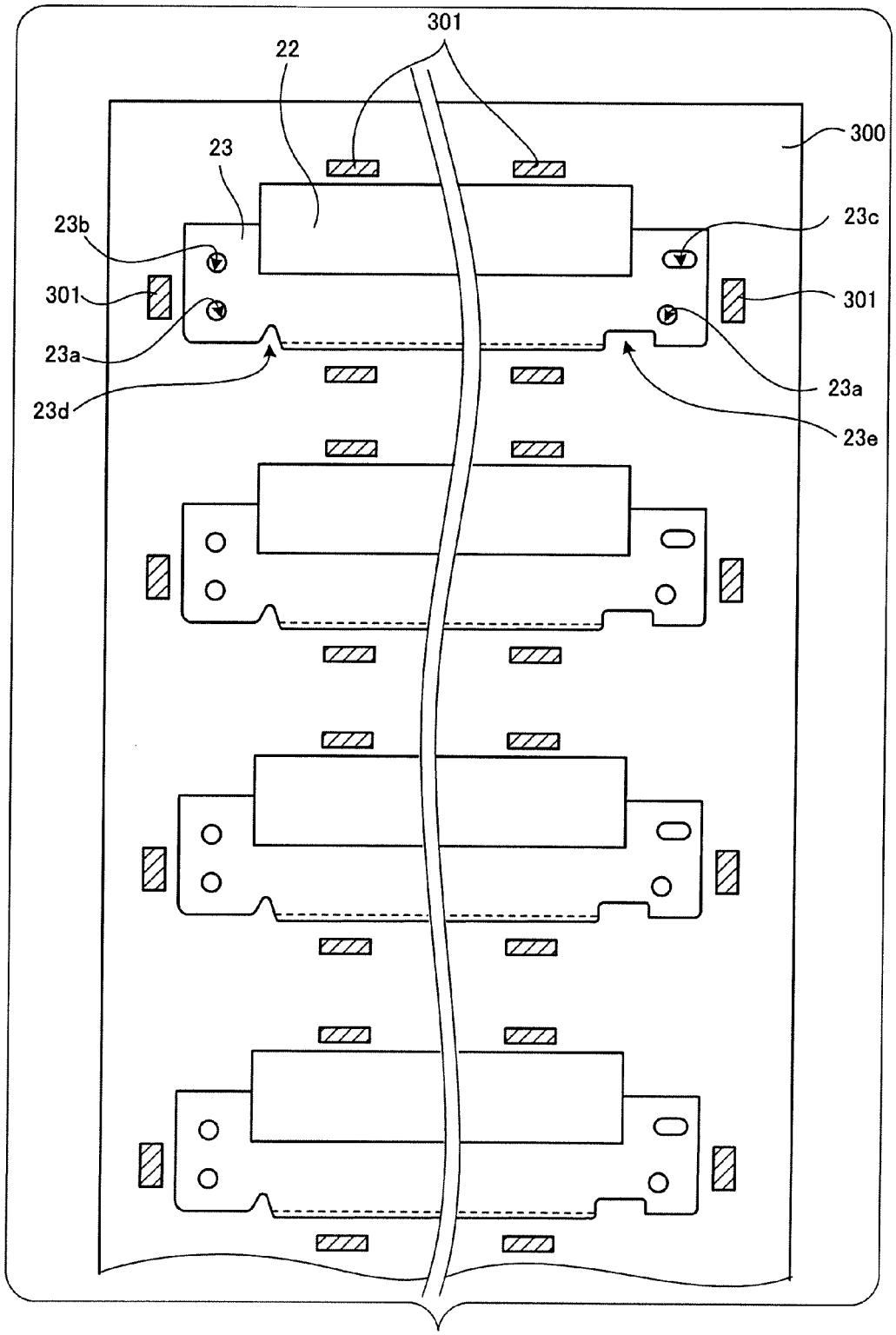
FIG. 8 is a view showing the blade supporting plate accommodated in an accommodation tray.

FIG. 8 is a view showing the blade supporting plate 23 accommodated in the accommodation tray.

FIG. 8 shows that the blade supporting plates 23 supporting the blades 22 are accommodated in chambers partitioned by protruding portions 301 on an accommodation tray 300. It should be noted that each chamber has a size sufficient for accommodating the blade supporting plate 23. Thus, there are some irregularities in positions where the blade supporting plates 23 are located in chambers.

In addition, FIG. 8 shows that the blade supporting plate 23 accommodated in each chamber has, on its ends, the round hole 23*b* through which the boss 2101 formed in the cleaning frame 21 is inserted, the long hole 23*c*, and though holes 23*a* to be used for screwing the blade supporting plate 23 onto the cleaning frame 21.

Further, FIG. 8 shows that the triangle notch 23*d* and the rectangular notch 23*e* are formed in the blade supporting plate 23. Here, the first recess corresponds to the rectangular notch 23*e* and the second recess corresponds to the triangle notch 23*d*.

Now, descriptions will be made on the component gripping device 100 that is installed onto one of arms of an industrial robot and is to grip the blade supporting plate 23 accommodated in the accommodation tray 300.

FIGS. 9A-9E are schematic views of the component gripping device 100 as viewed from its side surface, and FIGS. 10A-10D are plan views of the component gripping device 100 as viewed in the direction indicated by the arrow X of FIG. 9A.

The component gripping device 100 has a vacuum section 101, a vacuum pipe 1011, an arm control section 102, a lateral arm 103, a first vertical arm 104, a second vertical arm 105, and a third vertical arm 106.

The vacuum section 101 is a base of the component gripping device 100 and serves to suck the blade supporting plate 23 in contact with the edge of the vacuum pipe 1011 by vacuuming operation of the vacuum pipe 1011.

The arm control section 102 controls movement of the lateral arm 103 in a lateral direction as well as movement of the first vertical arm 104, the second vertical arm 105, and the third vertical arm 106 in a vertical direction. Specifically, movement of the lateral arm 103 in the lateral direction is controlled by being extended from and pulled into the inside of the arm control section 102 via the rack and pinion mechanism. Similarly, via the rack and pinion mechanism, movement of the first vertical arm 104 in the vertical direction is controlled by being caused to move close to and away from the arm control section 102 and the movement of the second vertical arm 105 and the third vertical arm 106 in the vertical direction is caused to move close to and away from the lateral arm 103. Note that the arm control section 102 and the lateral arm 103 are respectively disposed in pairs as shown in FIGS. 10A-10D. In addition, the first vertical arm 104, the second vertical arm 105, and the third vertical arm 106 are of cylindrical shape and disposed in pairs as shown in FIGS. 10A-10D. Further, as indicated by dotted lines in FIGS. 10A-10D, there are 3 vacuum pipes 1011 disposed in the component gripping device 100. Incidentally, FIGS. 9A-9E show the movements of the arm control section 102, the lateral arm 103, the first vertical arm 104 and the second vertical arm 105 that represent only left side of the component gripping device 100 shown in FIGS. 10A-10D. The second vertical arm 105 is an example of the first movable member of the present invention, and the third vertical arm 106 is an example of the second movable member of the present invention.

FIG. 9A shows that the component gripping device 100 installed at one of the industrial robot's arms is moved to a position above one of the blade supporting plates 23 accommodated in the accommodation tray 300 to grip it. In FIG. 9A, the lateral arm 103 is extended to a position farthest away from the arm control section 102, and the first vertical arm 104 and the second vertical arm 105 are in the positions farthest away from the arm control section 102 and the lateral arm 103, respectively.

Figure 10A:
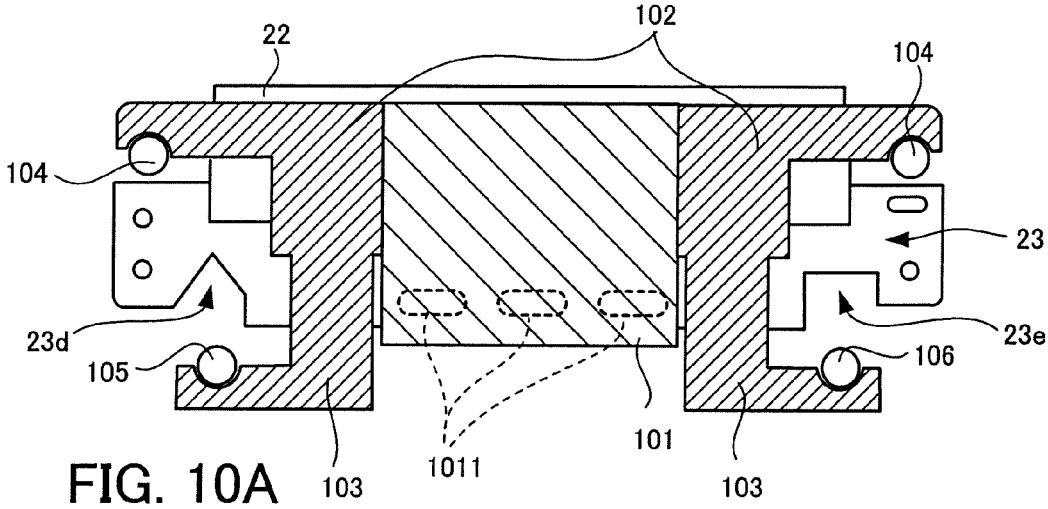
FIGS. 10A-10D are plane views of the component gripping device as viewed in the direction indicated by X of FIG. 9A.

In the component gripping device 100 shown in FIG. 9B, the front edge of the vacuum pipe 1011 is caused to contact the upper surface of the blade supporting plate 23. In this state, there is a gap between the blade supporting plate 23 and the first, second, and third vertical arms 104, 105, 106. Although the positions of the blade supporting plates 23 accommodated in the chambers of the accommodation tray are irregular, the margin of error in the positions is suppressed such that the first, second, and third vertical arms 104, 105, 106 do not collide with the blade supporting plate 23 when they come down to grip the blade supporting plate 23, if the lateral arm 103 is extended to the greatest extent. FIG. 10A shows that the component gripping device 100 shown in FIG. 9B is viewed in the direction indicated by the arrow X in FIG. 9A.

Figure 10B:
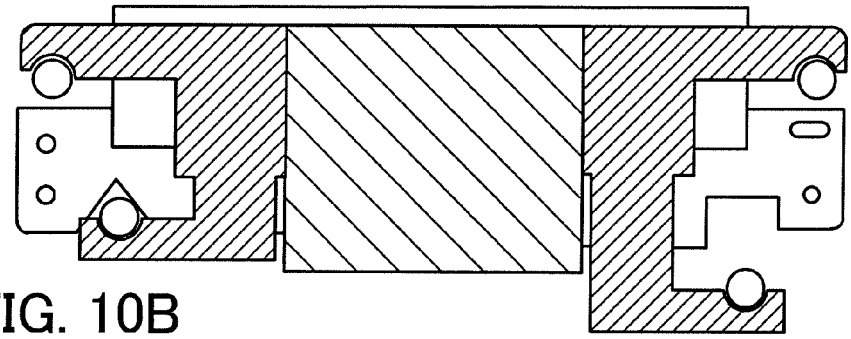

In FIG. 9C, while the first vertical arm 104 and the second vertical arm 105 remaining in the same position, the lateral arm 103 is moved closer to the arm control section 102 and enter the inlet of the entrance of the triangle notch 23*d*. FIG. 10B shows the component gripping device 100 as viewed in the direction expressed in X.

Figure 10C:
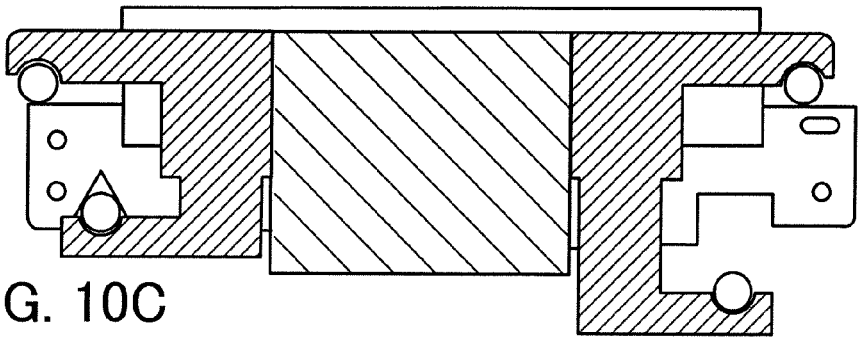

In FIG. 10C, as the lateral arm 103 is further moved toward the arm control section 102, the blade supporting plate 23 is moved toward the right side in the drawing so that the second vertical arm 105 comes in the center of the triangle notch 23*d*. Also in FIG. 9D, the second vertical arm 105 is moved to reach the center of the triangle notch 23*d*. At this stage, positioning of the blade supporting plate 23 relative to the component gripping device 100 in the lateral and vertical directions is almost determined. Note again that, although the positions of the blade supporting plates 23 accommodated in the chambers of the accommodation tray are irregular, margin of error is suppressed such that the second vertical arm 105 and the third vertical arm 106 respectively enter the triangle notch 23*d* and rectangular notch 23*e* without fail, if the second vertical arm 105 move following the lateral movement of the lateral arm 103 from the position where they go down into the accommodation tray 300 at the time of gripping the blade supporting plate 23.

Figure 10D:
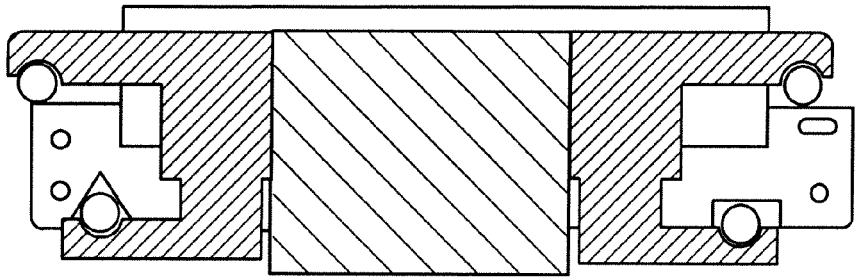

In right side of FIG. 10D, as the lateral arm 103 shown in the right side of the drawing is moved toward the arm control section 102, the third vertical arm 106 also shown in the right side enters the rectangular notch 23*e* of the blade supporting plate 23, so that the blade supporting plate 23 is held between the first vertical arm 104 and the second vertical arm 105. At this stage, the blade supporting plate 23 is made level by adjusting any inclination particularly toward the left side of the drawing, so that the position of the blade supporting plate 23 gripped by the component gripping device 100 is determined. In the component gripping device 100, the first vertical arm 104 and the second vertical arm 105 first hold the triangle notch-side portion of the blade supporting plate 23 therebetween to almost determine the position of the blade supporting plate 23 gripped by the component gripping device 100 both in the lateral direction and longitudinal direction. Subsequently, by holding the rectangular notch-side portion of the blade supporting plate 23 between the first and third vertical arms 104, 106 shown in the right side of FIG. 10A, the position of the blade supporting plate 23 gripped by the component gripping device 100 is finalized. On the contrary, if the rectangular notch-side portion is held first, the amount of movement of the blade supporting plate 23 relative to the predetermined gripping position may become larger depending on the position where the blade supporting plate 23 is gripped in the rectangular notch 23*e*, which causes overload on the blade supporting plate 23. In addition, the round hole 23*b* used for arranging the blade supporting plate 23 in the cleaning frame 21 is formed in a position closer to the triangle notch 23*d* away from the rectangular notch 23*e*. This is because positioning of the blade supporting plate 23 relative to the cleaning frame 21 is performed based on the triangle notch-side portion that determines a unified gripping position of the blade supporting plate 23 relative to the component gripping device 100 in the lateral and vertical directions. Accordingly, positioning of the blade supporting plate 23 relative to the cleaning frame 21 can be accurately performed based on the position of the blade supporting plate 23 gripped by the component gripping device 100.

In FIG. 9E, the first and second vertical arms 104, 105 are moved closest to the arm control section 102 and the lateral arm 103 respectively, which cancels their front ends to extend off the blade supporting plate 23 in the thickness direction of the blade supporting plate 23. However, this cancellation does not affect determined positioning of the blade supporting plate 23 relative to the component gripping device 100, since this movement of the first and second vertical arms 104, 105 are performed after the blade supporting plate 23 is sucked by vacuuming operation of the vacuum pipe 1011. On the contrary, if the front ends of the first and second vertical arms 104, 105 remain extended off the blade supporting plate 23 in the thickness direction, they collide with the cleaning frame 21 at the time of mounting the blade supporting plate 23 on the cleaning frame 21, which causes misalignment of the blade supporting plate 23 relative to the cleaning frame 21. In order to prevent collision, there arises the need to form a recess to prevent collision between the cleaning frame 21 and the front ends of the first and second vertical arms 104, 105. At the time shown in FIG. 9E, the extension of the front ends of the first and second vertical arms 104, 106 shown in the right side of FIG. 10A is already solved.

As described above, the blade supporting plate 23 that is gripped by the component gripping device 100 in unified positional relationship to the component gripping device 100 is to be mounted on an approximately fixed position of the cleaning frame 21 that is placed in a predetermined position of the work table. Thus, it becomes possible to easily insert the bosses of the cleaning frame 21 into the holes formed in the blade supporting plate 23. Accordingly, the blade supporting plate 23 of the present embodiment is capable of contributing to improved installation operability as well as meeting the demand for miniaturization. In addition, the component gripping device 100 of the present embodiment is capable of gripping the blade supporting plate 23 favorably.

In the above exemplary embodiment, the rectangular notch 23*e* is described as an example of the second recess according to the present invention, and the third vertical arm 106 having a shape of a cylindrical bar is described as an example of the second movable member according to the present invention. However, the second recess may be a rectangular notch having an approach at its entrance to guide the third vertical arm 106 and the bottom having a width equal to the diameter of the third vertical arm 106, if the relative position of the main body of the plate member and the second movable member is restricted both in the lateral direction and the longitudinal direction by pressing the second movable member against at least two positions in the second recess. Or the second recess according to the present invention may be a trapezoid notch or a U-shaped notch that becomes narrower toward the bottom. Alternatively, the second movable member according to the present invention may have a triangular cross section.

Although in the exemplary embodiment, the component gripping device 100 sucks the blade supporting plate 23 in a predetermined gripping position by vacuuming operation, the component gripping device according to the present invention may suck the blade supporting plate by electromagnet.

Further, although in the exemplary embodiment, the first recess and the second recess also serve as notches necessary at the time of bending a reinforcement member, but the first recess and the second recess maybe formed independently of the notches.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling other skilled in the art to understand the invention for various embodiments and with the various modifications as are suited to the particular use contemplated. It is intended that the scope of the invention be defined by the following claims and their equivalents.

What is claimed is:

1. A gripping device that grips a plate member provided with a long plate body, a first recess formed as a part of the plate body and has a shape recessed along a shorter length of the plate body; and a second recess formed as a part of the plate body at a position spaced apart from the first recess along a longer length of the plate body and has a shape recessed along the shorter length of the plate body, the gripping device comprising:

a first movable member entering the first recess;

a second movable member entering the second recess; and an opposing member group including at least one opposing member, the opposing member group being opposed to the first and second movable members along the shorter length of the plate body and serving to grip the plate member along the shorter length of the plate body in cooperation with the first and second movable members, wherein the gripping device grips the plate member by causing the second movable member to press against at least two positions of the second recess as well as causing the first movable member to press against a bottom of the first recess.

2. The gripping device according to claim 1, wherein the second movable member comes in contact with the second recess shaped like a letter V or U.

3. The gripping device according to claim 1, wherein the gripping device grips a plate member of which the first recess enables relative position of the plate body and the first member to be controlled along the shorter length of the plate body and the second recess enables relative position of the plate body and the first member to be controlled both along the longer and shorter length of the plate body.

4. The gripping device according to claim 1, wherein the first movable member is caused to press against the bottom of the first recess after the second movable member is caused to press against at least two positions in the second recess.

5. The gripping device according to claim 1, further comprising:

a sucking section that sucks the plate member positioned by the first movable member, the second movable member, and the opposing member to keep a posture of the plate member, wherein the positioning by the first movable member, the second movable member, and the opposing member is released after the plate member is sucked by the sucking section.

6. A plate member comprising:

a long plate body;

a first recess formed as a part of the plate body, the first recess having a shape recessed along a shorter length of the plate body and enabling relative position of the plate body and the first member to be controlled along the shorter length of the plate body, by causing a bottom of the first recess to be pressed by a first member of a gripping device; and a second recess formed as a part of the plate body at a position spaced apart from the first recess along a longer length of the plate body, the second recess having a shape recessed along the shorter length of the plate body and enabling relative position of the plate body and a second member to be controlled both along the shorter and longer length of the plate body, by causing at least two positions in the second recess to be pressed by the second member of the gripping device.

7. The plate member according to claim 6, wherein the second recess has a pair of walls spacing of which narrows further toward a bottom of the recess, and the second member is pressed against the pair of walls.

8. The plate member according to claim 6, wherein the plate member is gripped by the gripping device, carried and secured to a fixed location, and a protrusion for positioning the plate member is formed at the fixed location, the plate member further comprising:

a first opening provided with a long hole that receives the protrusion and thereby controls relative position of the plate body and the fixed location along the shorter length of the plate body except along the longer length of the plate body, the long hole formed at a position closer to the first recess than the second recess of the plate body; and a second opening provided with a hole that receives the protrusion and thereby controls relative position of the plate body and the fixed location both along the longer and shorter length of the plate body, the hole formed at a position closer to the second recess than the first recess of the plate body.

9. The plate member according to claim 6, further comprising:

a reinforcement member that is formed by bending a part of the plate body and that extends along the longer length of the plate body, wherein the first recess is formed adjacent to one end of the reinforcement member, and the second recess is formed adjacent to the other end of the reinforcement member.

10. A gripping method that grips a plate member provided with a long plate body, a first recess formed as a part of the plate body and has a shape recessed along a shorter length of the plate body; and a second recess formed as a part of the plate body at a position spaced apart from the first recess along a longer length of the plate body and has a shape recessed along the shorter length of the plate body, the gripping method comprising:

a first gripping that grips the plate member by causing the first movable member entering the first recess to press against a bottom of the first recess in cooperation with an opposing member that is opposed to the first movable member along the shorter length of the plate body; and a second gripping that grips the plate member by causing the second movable member to press against at least two positions of the second recess in cooperation with an opposing member that is opposed to the second movable member along the shorter length of the plate body.

11. The gripping method according to claim 10, wherein the second gripping causes the second movable member to press against the second recess shaped like a letter of V or U.

12. The gripping method according to claim 10, wherein the first gripping causes the first movable member to press against the first recess that enables relative position of the plate body and the first movable member to be controlled along the shorter length of the plate body, and the second gripping causes the second movable member to press against the second recess that enables relative position of the plate body and the second member to be controlled both along the shorter and longer length of the plate body.

13. The gripping method according to claim 10, wherein the first gripping is performed after the second gripping is performed.

14. The gripping method according to claim 10, further comprising:

sucking that sucks the plate member positioned by the first movable member, the second movable member, and the opposing member to keep a posture of the plate member, wherein the positioning by the first movable member, the second movable member, and the opposing member is released after the plate member is sucked by the sucking.

* * * * *